US008021026B2

(12) United States Patent
Liu et al.

(10) Patent No.: US 8,021,026 B2
(45) Date of Patent: Sep. 20, 2011

(54) LAMP WITH ANGLE ADJUSTING MEMBER

(75) Inventors: Yi-San Liu, Shenzhen (CN); You-Xue Liu, Shenzhen (CN); Li He, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 271 days.

(21) Appl. No.: 12/542,726

(22) Filed: Aug. 18, 2009

(65) Prior Publication Data

US 2010/0309673 A1 Dec. 9, 2010

(30) Foreign Application Priority Data

Jun. 5, 2009 (CN) ..... 2009 1 0302990

(51) Int. Cl.
*F21V 21/30* (2006.01)
*F21S 8/08* (2006.01)

(52) U.S. Cl. ..... 362/419; 362/287; 362/427; 362/431

(58) Field of Classification Search ..... 362/418, 362/419, 421, 427, 414, 431, 249.03, 249.07, 362/249.09, 249.1

See application file for complete search history.

(56) References Cited

U.S. PATENT DOCUMENTS

| | | | | |
|---|---|---|---|---|
| 1,481,998 | A * | 1/1924 | Eldredge | 248/170 |
| 5,424,931 | A * | 6/1995 | Wheeler | 362/418 |
| 6,394,631 | B1 * | 5/2002 | Yuen | 362/399 |
| 2008/0253138 | A1 * | 10/2008 | Katz et al. | 362/427 |

* cited by examiner

*Primary Examiner* — Thomas Sember
(74) *Attorney, Agent, or Firm* — Altis Law Group, Inc.

(57) ABSTRACT

A lamp includes a lamp pole, a lamp head and an adjustable component. The adjustable component comprises an engaging portion and an adjustable portion pivotably connecting with the engaging portion via a pivot shaft. The adjustable portion mounted on the lamp head defines a plurality of adjustable holes therein. The engaging portion receiving a front end of the lamp pole therein and secured to the lamp pole, defines a plurality of engaging holes located corresponding to the adjustable holes. The adjustable portion is rotatable about the pivot shaft relative to the engaging portion. Two screws extend through the adjustable portion and screw into the engaging portion to connect the adjustable portion and the engaging portion together. When the adjustable portion is rotated from a first position to a second position, an elevation angle of the adjustable portion and accordingly the lamp head relative to the lamp pole is varied.

12 Claims, 5 Drawing Sheets

LAMP WITH ANGLE ADJUSTING MEMBER

BACKGROUND

1. Technical Field

The disclosure relates to a lamp and, more particularly, to an LED lamp whose illuminating angle is adjustable.

2. Description of Related Art

Traditionally, a lamp generally includes a lamp head and a lamp pole supporting the lamp head. Typically, the lamp pole has a certain configuration. The lamp head is immovable relative to the lamp pole when the lamp head is mounted to the lamp pole. Therefore, in use, the lamp pole is held at a certain position, and generally determines a constant elevation angle of the lamp head relative to a place needing illumination. According to the actual requirement, different places may need illumination by the same lamp; thus, an adjustable lamp head which can be moved to aim at different elevation angles is needed.

However, according to the structure of the lamp pole and the lamp head, the elevation angle of the lamp head relative to the places needing illumination is invariable, which cannot meet the requirement of illuminating different places.

What is needed, therefore, is a lamp comprising a lamp head whose orientation is adjustable in respect to the lamp pole, thereby overcoming the described limitations.

BRIEF DESCRIPTION OF THE DRAWINGS

Other advantages and novel features of the disclosure will become more apparent from the following detailed description of an embodiment/embodiments when taken in conjunction with the accompanying drawings.

DETAILED DESCRIPTION

Figure 1:
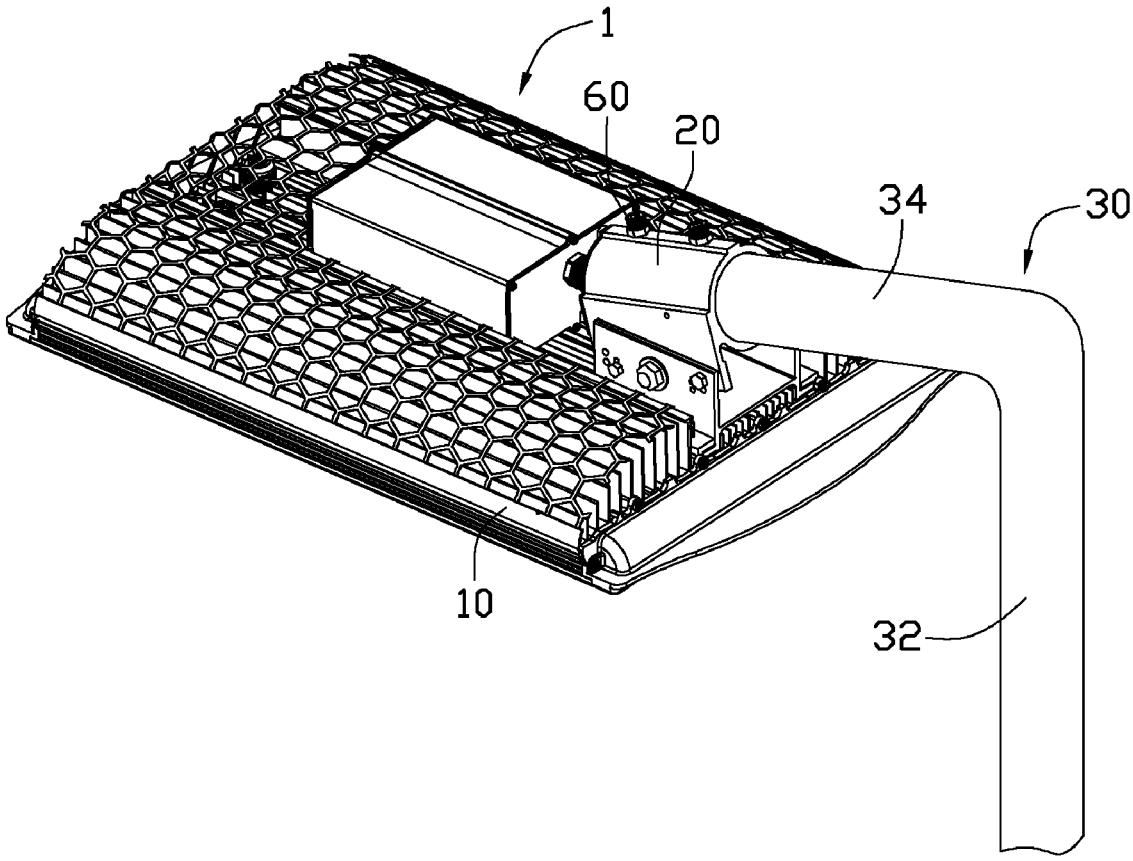
FIG. 1 is an assembled, isometric view of a lamp in accordance with an exemplary embodiment of the disclosure.
Figure 2:
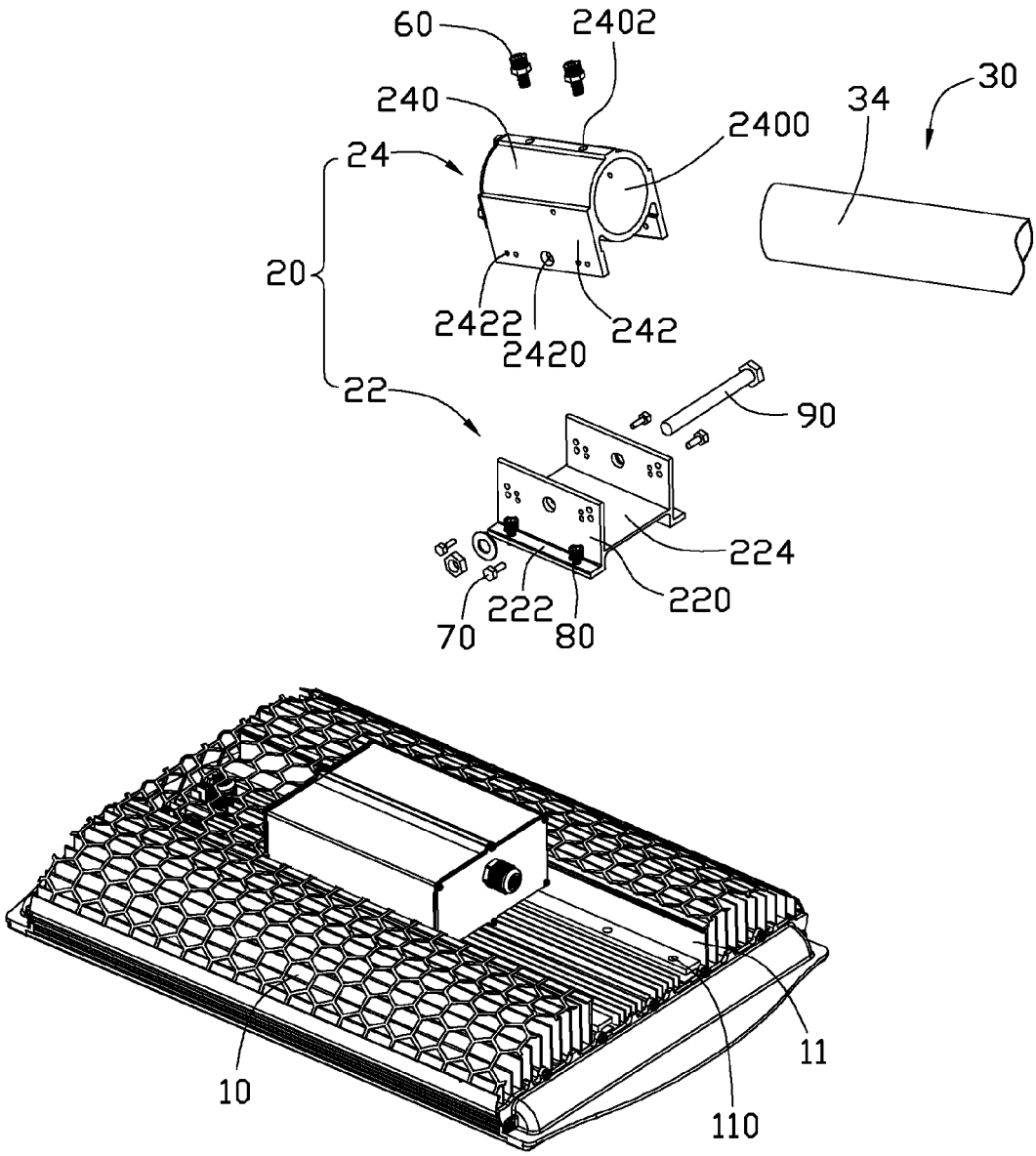
FIG. 2 is an exploded view of the lamp of FIG. 1.

Referring to FIGS. 1-2, a lamp 1 in accordance with an embodiment of the disclosure is shown. In this embodiment, the lamp 1 is an LED lamp used as a street lamp. The lamp 1 comprises a lamp head 10 and an adjustable component 20 connecting with the lamp head 10 and a lamp pole 30. The adjustable component 20 is rotatable relative to the lamp pole 30 to adjust an angle of the lamp head 10 with respect to the lamp pole 30. The lamp pole 30 is elongated and cylindrical, and comprises a vertical portion 32 and a connector 34 integrally and slantwise downwardly extending from a top end of the vertical portion 32.

The lamp head 10 comprises a lamp body 11 having a plurality of LED modules (not shown) therein for providing illumination. Two pairs of mounting holes 110 are defined in a top surface of a front portion of the lamp body 11, for mounting the adjustable component 20 to the lamp head 10. The two pairs of mounting holes 110 are symmetrically located in the top surface of the lamp body 11 about a middle line of the lamp body 11. The mounting holes 110 of each pair are spaced from each other and arranged in a line parallel to two lateral sides of the lamp body 11.

Figure 3:
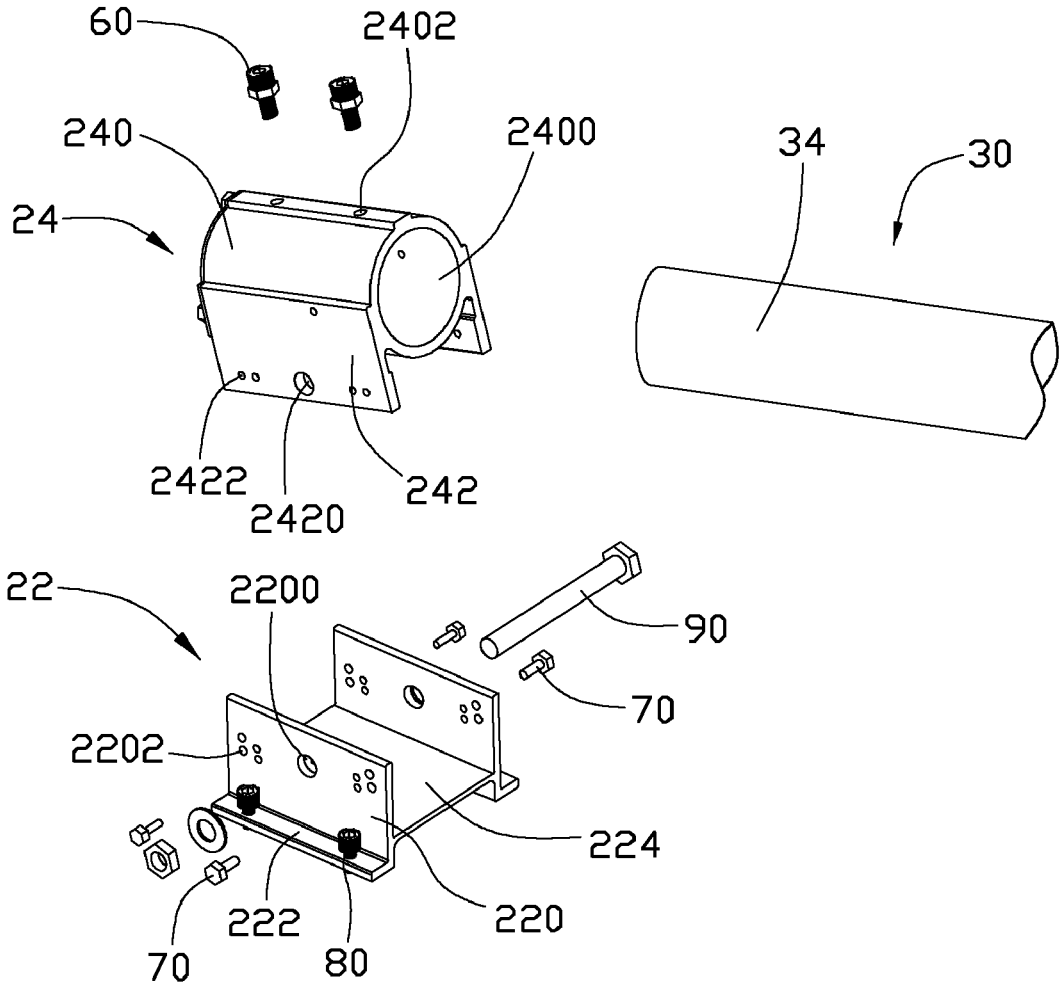
FIG. 3 is an enlarged, exploded view of an adjustable component and a lamp pole of the lamp of FIG. 2.

As shown in FIGS. 2 and 3, the adjustable component 20 comprises an adjustable portion 22 and an engaging portion 24 pivotably connecting with the adjustable portion 22. The adjustable portion 22 is mounted on the top surface of the lamp body 11 of the lamp head 10 and the engaging portion 24 is secured to the connector 34 of the lamp pole 30. The adjustable portion 22 comprises a pair of spaced and parallel adjustable plates 220 and a connecting plate 224 interconnecting the pair of adjustable plates 220. Each adjustable plate 220 comprises a mounting flange 222 extending outwardly from a bottom thereof and a pair of through holes (not labeled) defined in the mounting flange 222 and in alignment with the mounting holes 110 of the lamp head 10. Fasteners 80 extend through the through holes of the mounting flange 222 of the adjustable portion 22 and screw into the mounting holes 110 of the lamp head 10 to mount the adjustable portion 22 to the lamp head 10. A first pivot hole 2200 is defined in a middle of each adjustable plate 220 and two groups of adjustable holes 2202 are defined adjacent to two opposite sides of the corresponding the adjustable plate 220. The two groups of adjustable holes 2202 are symmetrically arranged about the first pivot hole 2200 and adjacent to an upper side of the adjustable plate 220. In this embodiment, each group of adjustable holes 2202 comprises four adjustable holes 2202 arranged in two columns along a horizontal direction. Each column comprises two adjustable holes 2202 and is arranged along an imaginary arc having the first pivot hole 2200 as the centre of the arc. A distance between an outer column of the adjustable holes 2202 and the first pivot hole 2200 is larger than that between an inner column of the adjustable holes 2202 and the first pivot hole 2200. It is understood that the amount of the adjustable holes 2202 defined in the adjustable plate 220 is variable; the only requirement is that the adjustable holes 2202 in the same column are in the same arc.

The engaging portion 24 comprises a tubular-shaped body 240 defining a chamber 2400 receiving the connector 34 of the lamp pole 30 therein. The body 240 defines a pair of screw holes 2402 at a top wall (not labeled) thereof along an axis thereof. The screw holes 2402 both extend through the top wall of the body 240 of the engaging portion 24, whereby fasteners 60 extend through the screw holes 2402 and screw into the top surface of the connector 34 of the lamp pole 30 to secure the engaging portion 24 to the connector 34 of the lamp pole 30. A pair of parallel engaging plates 242 extends vertically and downwardly from two opposite sidewalls of the body 240 of the engaging portion 24. A distance between the engaging plates 242 is smaller than that of the adjustable plates 220, whereby the engaging plates 242 of the engaging portion 24 are located between the adjustable plates 220 of the adjustable portion 22, when the adjustable portion 22 and the engaging portion 24 are assembled together. Each engaging plate 242 defines a second pivot hole 2420 corresponding to the first pivot hole 2200 of each of the adjustable plates 220. The second pivot hole 2420 is adjacent to a bottom of the engaging plate 242 and in alignment with the first pivot hole 2200 of each of the adjustable plates 220 of the adjustable portion 22. Two groups of engaging holes 2422 located corresponding to the two groups of the adjustable holes 2202 are defined in the engaging plate 242 and arranged at two opposite sides of the second pivot hole 2420 and adjacent to the bottom of the engaging plate 242. Each group of the engaging holes 2422 which has two engaging holes 2422. One of the two engaging holes 2422 is arranged in alignment with one of the adjustable holes 2202 in a corresponding group of the adjustable holes 2202 of each of the adjustable plates 220 of the adjustable portion 22. A distance between an outer engaging hole 2422 of each group of the engaging holes 2422 and the second pivot hole 2420 is equal to that between the adjustable holes 2202 at the outer column and the first pivot hole 2200 of each of the adjustable plates 220 of the adjustable portion 22. A distance between an inner engaging hole 2422 and the second pivot hole 2420 is equal to that between the adjustable holes 2202 at the inner column and the first pivot hole 2200 of each of the adjustable plates 220 of the adjustable portion 22. A pivot shaft 90 extends through the first and second pivot hole 2202, 2420 to pivotally connect the adjustable portion 22 and the engaging portion 24 together. Two fasteners 70 are extended through corresponding adjustable holes 2202 in each of the adjustable plates 220 and screw into corresponding engaging holes 2422 in a corresponding one of the engaging plates 242 to secure the adjustable portion 22 to the engaging portion 24. In the present embodiment, the fasteners 70 are screws. It is understood that the group of engaging holes 2422 which has two engaging holes 2422 (i.e., an inner one and an outer one) can have only one of the two engaging holes 2422 aligning with one of the four adjustable holes 2202 of each group of the adjustable holes 2202 when the adjustable plates 220 of the adjustable portion 22 is located relative to engaging plates 242 of the engaging portion 24 at one of two lockable positions.

Figure 4:
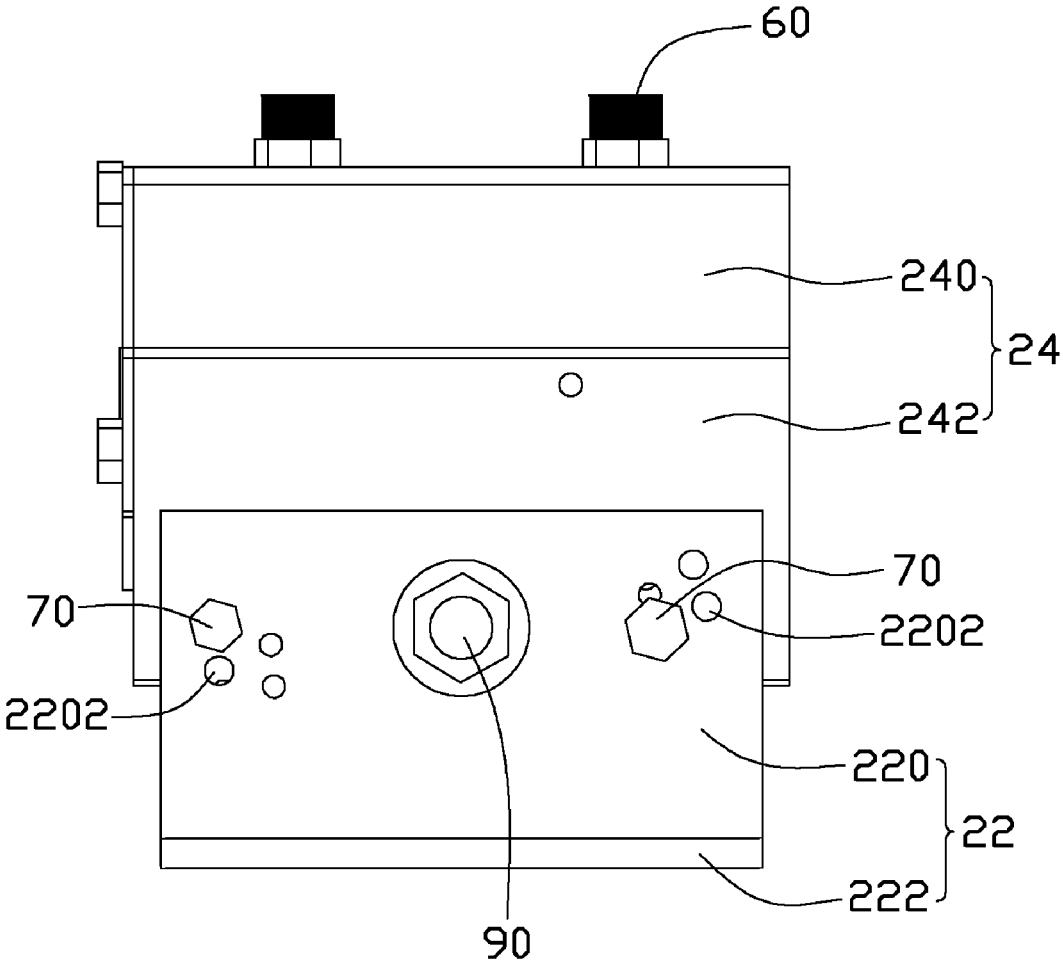
FIG. 4 is an assembled lateral view of the adjustable component of the lamp of FIG. 3 in a first position.

Referring to FIG. 4, the lamp 1 after assembly is in a first position. In this position, the lamp head 10 of the lamp 1 is parallel to the adjustable portion 22 is parallel to the engaging portion 24. Thus, the adjustable portion 22 has an angle of zero degree with respect to the engaging portion 24. Therefore, in use, the lamp head 10 defines a first elevation angle relative to the horizontal direction, which is determined by the inclined angle of the connector 34 of the lamp pole 30. In the first position, the lamp head 10 is oriented to a first place needing illumination. Moreover, in the first position, one of two the fasteners 70 corresponding to an adjustable plate 220 extends through an upper one at the outer column of the group of the adjustable holes 2202 near a front side of the adjustable plate 220 to screw in an outer one of the group of the engaging holes 2422 near a front side of the engaging plate 242, and the other fastener 70 extends through a lower one at the inner column of the group of the adjustable holes 2202 near a rear side of the adjustable plate 220 to screw in an inner one of the group of the engaging holes 2422 near a rear side of the engaging plate 242.

Figure 5:
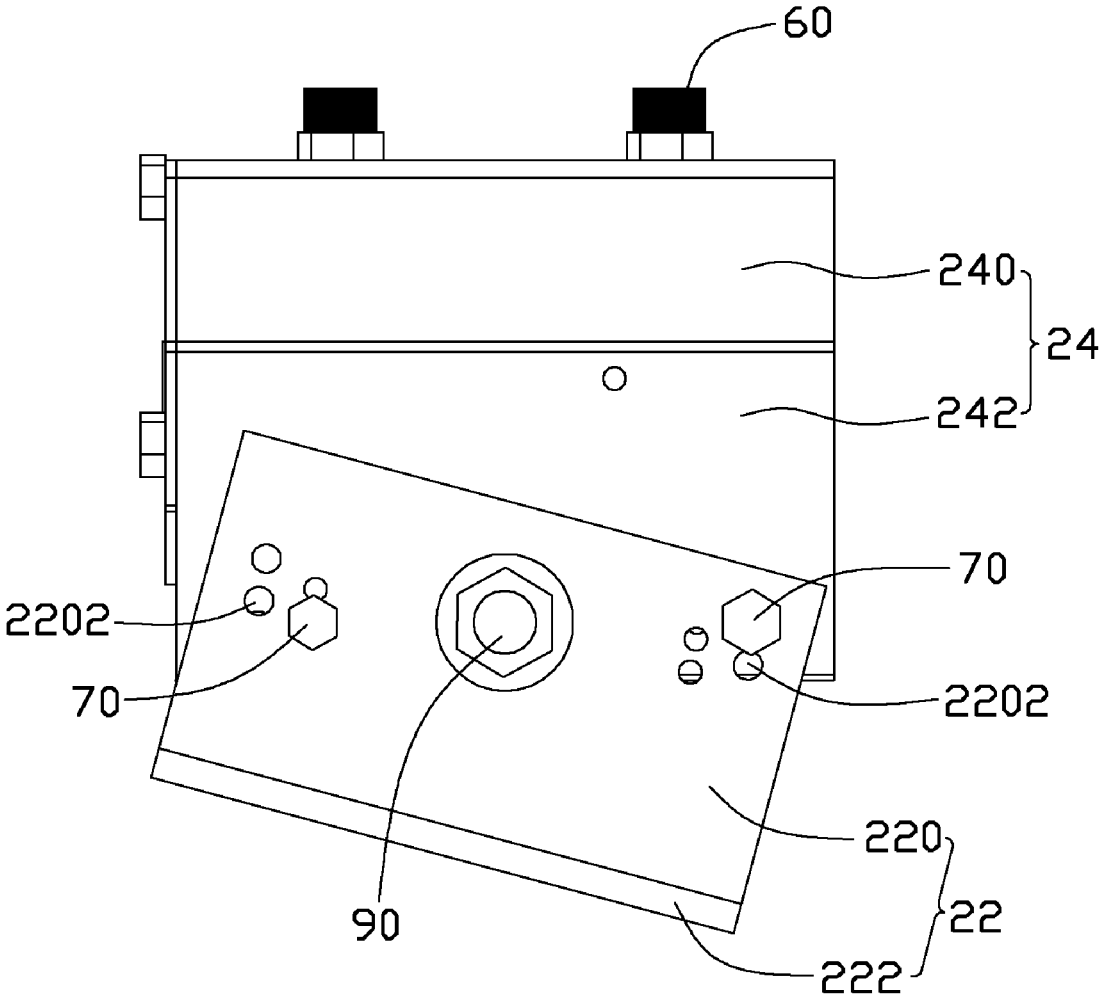
FIG. 5 is a view similar to FIG. 4 with the adjustable component of the lamp in a second position.

Referring to FIG. 5, the lamp 1 is in a second position. In the second position, the adjustable portion 22 is rotated about the pivot shaft 90 after the fasters 70 are loosened from the engaging plates 242, thereby to change an angle between the adjustable portion 22 and the engaging portion 24. Thereafter, the fasteners 70 are used to secure the adjustable portion 22 and the engaging portion 24 together again. In the second position, a front end of the lamp head 10 connecting with the adjustable portion 22 of the adjustable component 20 raises upwardly thereby to increase the elevation angle of the lamp head 10. Therefore, in this second position, the lamp head 10 defines a second elevation angle relative to the horizontal direction and is oriented toward a second place needing illumination. According to the requirements of different illuminating angles and illumination of different places, the lamp head 10 can be adjusted to a suitable angle with respect to the horizontal direction, with adjustment of a position of the adjustable portion 22 relative to the engaging portion 24 to a suitable position. In the second position, one of the two fasteners 70 corresponding to an adjustable plate 220 extends through a lower one at the inner column of the group of the adjustable holes 2202 near a front side of the adjustable plate 220 to screw in an inner one of the group of the engaging holes 2422 near a front side of the engaging plate 242, and the other fastener 70 extends through an upper one at the outer column of the group of the adjustable holes 2202 near a rear side of the adjustable plate 220 to screw in an outer one of the group of the engaging holes 2422 near a rear side of the engaging plate 242.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A lamp comprising:

a lamp head comprising an adjustable component located at a rear end of the lamp head, the adjustable component comprising an adjustable portion, an engaging portion and a pivot shaft extending through the adjustable and engaging portions to pivotably connect the adjustable and engaging portions together, the adjustable portion being mounted on the lamp head and the engaging portion being secured to a front end of a lamp pole, the adjustable portion defining a plurality of adjustable holes therein and the engaging portion defining a plurality of engaging holes therein, which are located corresponding to the adjustable holes;

wherein the adjustable portion of the adjustable component is rotated along the pivot shaft relative to the engaging portion and securable to the engaging portion at different positions, in which the lamp head has different elevation angles, thereby to adjust an elevation angle of the lamp head by rotating and securing the adjustable portion at a selected one of the different positions so that the lamp head can illuminate different places; and wherein fasteners extend through selected ones of the adjustable holes at two opposite sides of the pivot shaft to engage with selected ones of the engaging holes at the two opposite sides of the pivot shaft when the lamp head is at a first elevation angle, and wherein the fasteners extend through other ones of the adjustable holes at the two opposite sides of the pivot shaft to engage with other ones of the engaging holes at the two opposite sides of the pivot shaft when the lamp head is at second elevation angle.

2. The lamp of claim 1, wherein the adjustable portion of the adjustable component comprises a plurality of adjustable plates and each adjustable plate defines a first pivot hole therein, the plurality of adjustable holes being defined in the adjustable plates.

3. The lamp of claim 2, wherein each adjustable plate comprises a mounting flange extending from a side thereof, fasteners extending through the mounting flange and engaging in the lamp head to mount the adjustable portion on the lamp head.

4. The lamp of claim 3, wherein the adjustable portion comprises a connecting plate interconnecting the adjustable plates together.

5. The lamp of claim 1, wherein the engaging portion comprises a tubular-shaped body defining a chamber receiving the front end of the lamp pole therein.

6. The lamp of claim 5, wherein the engaging portion comprises a plurality of engaging plates extending from two opposite sidewalls of the body thereof and each engaging plate defines a second pivot hole therein, the plurality of engaging holes being defined in the engaging plates.

7. The lamp of claim 6, wherein the engaging plates of the engaging portion are sandwiched between the adjustable plates of the adjustable portion.

8. The lamp of claim 7, wherein the body of the engaging portion defines a plurality of fixing holes in a top wall thereof, fasteners extending through the fixing holes and engaging with the front end of the lamp pole to secure the engaging portion to the front end of the lamp pole.

9. The lamp of claim 8, wherein the second pivot hole and the engaging holes of the engaging plates of the engaging portion are arranged close to lower sides of the engaging plates.

10. The lamp of claim 1, wherein the lamp is an LED lamp.

11. A lamp comprising:

a lamp head;

a lamp pole; and an adjustable component connecting the lamp head to the lamp pole, the adjustable component comprising an adjustable portion, an engaging portion and a pivot shaft extending through the adjustable and engaging portions to pivotably connect the adjustable and engaging portions together, the adjustable portion being mounted on the lamp head and the engaging portion being secured to the lamp pole, the adjustable portion defining a plurality of adjustable holes therein and the engaging portion defining a plurality of engaging holes located corresponding to the adjustable holes of the adjustable portion, fasteners extending through the adjustable holes and corresponding engaging holes to secure the adjustable portion relative to the engaging portion;

wherein an elevation angle of the lamp head is capable of being adjusted by rotating the adjustable portion of the adjustable component relative to the engaging portion between at least first and second positions, in the first position the fasteners extending through selected ones of the adjustable holes of the adjustable portion of the adjustable component and secured in selected ones of the engaging holes of the engaging portion, at the second position, the fasteners extending through other ones of the adjustable holes of the adjustable portion of the adjustable component and secured in other ones of the engaging holes of the engaging portion.

12. The lamp of claim 11, wherein the lamp is an LED lamp.

* * * * *